US011377979B2

(12) United States Patent
Ikeya

(10) Patent No.: US 11,377,979 B2
(45) Date of Patent: Jul. 5, 2022

(54) TURBINE

(71) Applicant: IHI Corporation, Tokyo (JP)

(72) Inventor: Nobuyuki Ikeya, Tokyo (JP)

( * ) Notice: Subject to any disclaimer, the term of this patent is extended or adjusted under 35 U.S.C. 154(b) by 58 days.

(21) Appl. No.: 16/994,664

(22) Filed: Aug. 17, 2020

(65) Prior Publication Data

US 2020/0378276 A1 Dec. 3, 2020

Related U.S. Application Data

(63) Continuation of application No. PCT/JP2019/003908, filed on Feb. 4, 2019.

(30) Foreign Application Priority Data

Feb. 19, 2018 (JP) ..... JP2018-027167

(51) Int. Cl.
*F01D 25/32* (2006.01)
*F01D 25/16* (2006.01)
(Continued)

(52) U.S. Cl.
CPC ..... *F01D 25/32* (2013.01); *F01D 25/16* (2013.01); *F01D 25/24* (2013.01); *F01D 25/12* (2013.01);
(Continued)

(58) Field of Classification Search
CPC ..... F01D 25/12; F01D 25/16; F01D 25/24; F01D 25/32; F02B 39/00; F02B 39/16;
(Continued)

(56) References Cited

U.S. PATENT DOCUMENTS 3,428,242 A * 2/1969 Rannenberg ..... F02C 6/06 415/180
5,636,708 A * 6/1997 Wedeven ..... F01D 25/18 184/6.22
(Continued)

FOREIGN PATENT DOCUMENTS

CN 101504006 8/2009
CN 103429869 12/2013
(Continued)

OTHER PUBLICATIONS

International Search Report dated Mar. 26, 2019 for PCT/JP2019/003908.
(Continued)

*Primary Examiner* — Jesse S Bogue
(74) *Attorney, Agent, or Firm* — SOEI Patent & Law Firm

(57) ABSTRACT

A turbine includes a rotary shaft; a turbine impeller attached to the rotary shaft; a housing including a turbine housing that accommodates the turbine impeller; and a bearing that rotatably supports the rotary shaft. The turbine housing includes a first discharge path configured to discharge gas in a space, in which the bearing is provided, to an exhaust gas outlet port in the turbine housing. A bottom surface of the first discharge path is constituted of an inclined portion descending from a first inlet opening toward a first outlet opening, or is constituted of the inclined portion and a horizontal portion that continuously extends horizontally from the inclined portion.

20 Claims, 8 Drawing Sheets

(51) Int. Cl.
*F01D 25/24* (2006.01)
*F01D 25/12* (2006.01)

(52) U.S. Cl.
CPC ..... *F05D 2220/40* (2013.01); *F05D 2240/50* (2013.01); *F05D 2240/60* (2013.01); *F05D 2260/608* (2013.01)

(58) Field of Classification Search
CPC ..... F05D 2220/40; F05D 2240/50; F05D 2240/60; F05D 2260/608
See application file for complete search history.

(56) References Cited

U.S. PATENT DOCUMENTS

| | | | | |
|---|---|---|---|---|
| 7,402,020 | B2 * | 7/2008 | Beers | F04D 29/584 415/1 |
| 10,215,230 | B2 * | 2/2019 | Iannello | F16C 32/0607 |
| 10,927,845 | B2 * | 2/2021 | Lin | F04D 27/009 |
| 11,136,986 | B2 * | 10/2021 | Dozzini | F04D 17/122 |
| 2009/0158733 | A1 * | 6/2009 | Swenson | F01D 25/32 60/605.1 |
| 2009/0193845 | A1 | 8/2009 | Sugitani | |
| 2012/0328968 | A1 | 12/2012 | Honda | |
| 2013/0142671 | A1 | 6/2013 | Stein et al. | |
| 2014/0037436 | A1 | 2/2014 | Tabata | |
| 2014/0140814 | A1 | 5/2014 | Isono et al. | |
| 2017/0067369 | A1 | 3/2017 | Hashimoto et al. | |
| 2018/0087573 | A1 * | 3/2018 | Iannello | F01D 25/22 |
| 2019/0085768 | A1 | 3/2019 | Ikeya | |

FOREIGN PATENT DOCUMENTS

| | | |
|---|---|---|
| CN | 103835998 | 6/2014 |
| CN | 106030049 | 10/2016 |
| DE | 102011087606 | 6/2013 |
| DE | 102012211882 | 1/2014 |
| EP | 0246039 | 11/1987 |
| JP | S54-079039 | 11/1977 |
| JP | S60-018233 | 2/1985 |
| JP | S60-134834 | 9/1985 |
| JP | S60-173316 | 9/1985 |
| JP | S62-124325 | 8/1987 |
| JP | S62-267525 | 11/1987 |
| JP | 2007-071071 | 3/2007 |
| JP | 2009-228450 | 10/2009 |
| JP | 2013-008445 | 1/2013 |
| JP | 2016-199825 | 10/2017 |
| WO | 2014006060 | 1/2014 |
| WO | 2017199695 | 11/2017 |

OTHER PUBLICATIONS

International Preliminary Report on Patentability with Written Opinion dated Sep. 3, 2020 for PCT/JP2019/003908.

* cited by examiner

TURBINE

CROSS-REFERENCE TO RELATED APPLICATIONS

This application is a continuation application of PCT Application No. PCT/JP2019/003908, filed Feb. 4, 2019, which claims the benefit of priority from Japanese Patent Application No. 2018-027167, filed Feb. 19, 2018, the entire contents of which are incorporated herein by reference.

BACKGROUND

Each of Japanese Unexamined Utility Model Publication No. S60-18233 and Japanese Unexamined Patent Publication No. S60-173316 describes a turbocharger including a turbine and a compressor.

For example, Japanese Unexamined Utility Model Publication No. S60-18233 discloses a turbocharger in which a rotary shaft is supported on a journal bearing and a thrust bearing that are formed in a center housing. A flow path and a guide pipe connected to the flow path are provided in the center housing. The guide pipe is connected to a flow path provided in a turbine casing. When a turbine impeller is driven by exhaust gas to thereby cause a compressor outlet pressure to be higher than a compressor inlet pressure, air flows into the center housing from an outlet portion of a compressor impeller to cool the thrust bearing and the journal bearing. A part of the air flows to an outlet flow path of the turbine through the flow path and the guide pipe in the center housing and then through the flow path of the turbine casing.

Japanese Unexamined Patent Publication No. S60-173316 discloses a turbocharger in which a rotary shaft is supported on a journal bearing provided in a center housing and a thrust bearing provided between a turbine and the center housing. A guide path that communicates with a large number of air supply holes formed on the inside of the journal bearing is formed in an outer peripheral portion of the journal bearing. Compressed air is supplied to the guide path from a compressor outside via an air supply pipe. A discharge groove having an annular shape is formed in an inner peripheral bearing surface of the journal bearing. A guide hole connected to the discharge groove is formed to penetrate through the journal bearing and the center housing. A distribution groove connected to the guide hole is formed on the circumference of a center housing side of the thrust bearing. Further, the thrust bearing is provided with a blow-out hole that communicates with the distribution groove to open to a turbine side. The compressed air supplied from the compressor causes the journal bearing and the thrust bearing to support the rotary shaft. A part of the compressed air flows into the discharge groove of the journal bearing to be blown out from the distribution groove and the blow-out hole to a back surface side of the turbine.

SUMMARY

In a turbocharger including a turbine, moist gas (air containing water vapor) may flow into the turbine as exhaust gas. The turbine is operated by such a moist gas. When the water vapor condenses, water may be accumulated in a housing.

Here, a turbine housing may be provided with a flow path (discharge path) that discharges the gas flowing into a space where a bearing is provided. If the accumulated water flows into the discharge path to remain, the water can adversely affect the turbine. For example, when the water is frozen due to a decrease in temperature, the discharge path may be blocked, so that a defect may occur in components (for example, a rotary shaft and so on) in the housing.

The turbines disclosed herein may be configured to discharge condensate water that is accumulated in a space where a bearing is provided in a housing.

An example turbine includes a rotary shaft, a blade attached to the rotary shaft, a housing including a turbine housing that accommodates the blade, and a bearing provided in the housing to rotatably support the rotary shaft. Additionally, the turbine housing may include a discharge path configured to discharge gas in a first space, in which the bearing is provided, to a second space in the turbine housing. The discharge path may include an inlet opening that communicates with the first space and an outlet opening that opens to the second space. A bottom surface of the discharge path may be constituted of an inclined portion descending from the inlet opening toward the outlet opening. The bottom surface of the discharge path may be constituted of the inclined portion and a horizontal portion that continuously extends horizontally from the inclined portion.

DETAILED DESCRIPTION

Figure 1:
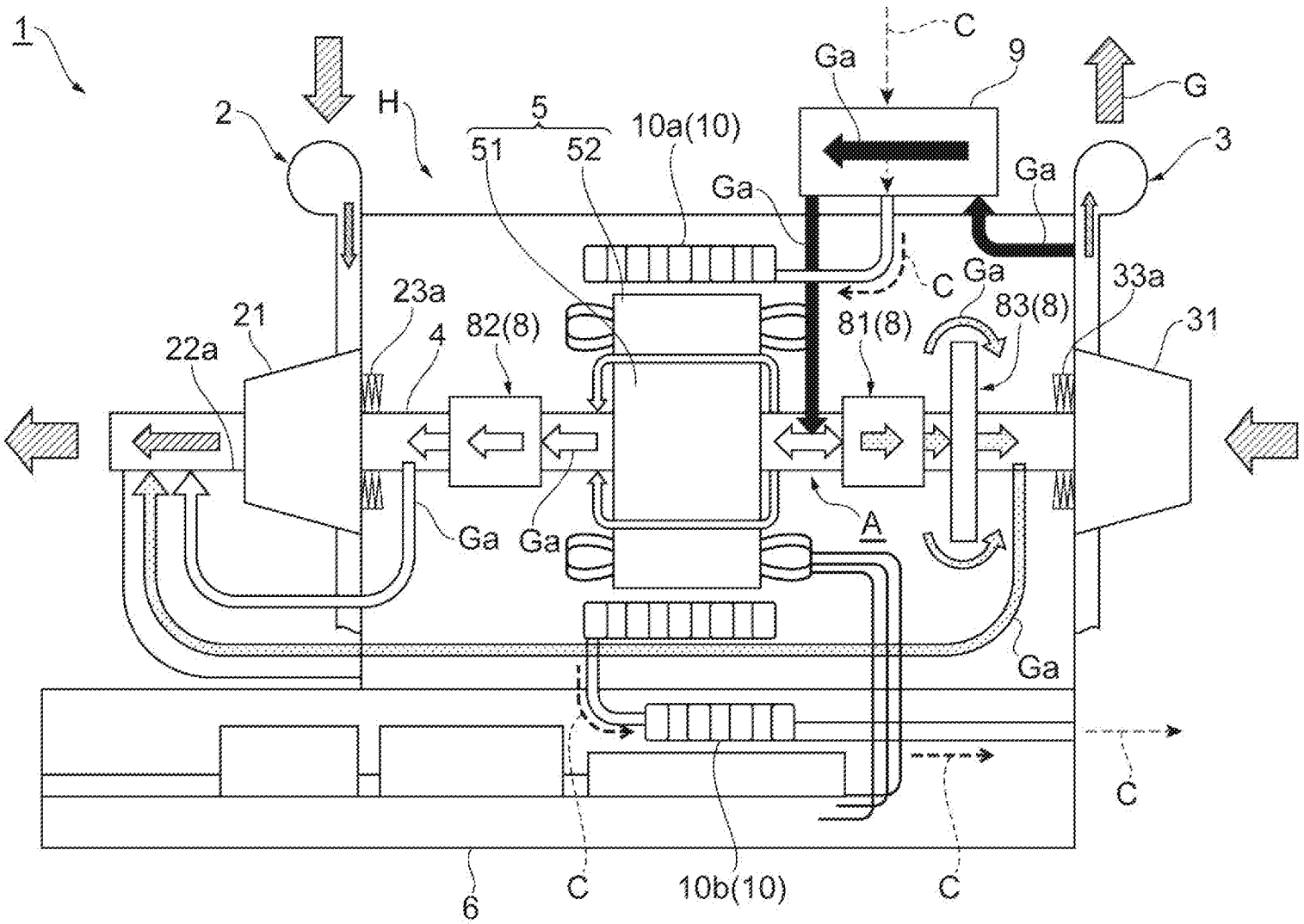
FIG. 1 is a schematic illustration of an example electric turbocharger (centrifugal compressor).

An example turbine includes a rotary shaft, a blade attached to the rotary shaft, a housing including a turbine housing that accommodates the blade, and a bearing provided in the housing to rotatably support the rotary shaft. Additionally, the turbine housing may include a discharge path configured to discharge gas in a first space, in which the bearing is provided, to a second space in the turbine housing. The discharge path may include an inlet opening that communicates with the first space and an outlet opening that opens to the second space. A bottom surface of the discharge path may be constituted of an inclined portion descending from the inlet opening toward the outlet opening. The bottom surface of the discharge path may be constituted of the inclined portion and a horizontal portion that continuously extends horizontally from the inclined portion.

The gas in the first space where the bearing is provided is discharged to the second space in the turbine housing through the discharge path. If the gas flowing into the turbine contains water vapor and condensate water generated by the condensation of the water vapor is accumulated in the housing, the condensate water may be accumulated also in the first space. When the water level of the condensate water reaches the inlet opening of the discharge path, the condensate water enters the discharge path. The bottom surface of the discharge path is constituted of the inclined portion descending toward the outlet opening or is constituted of the inclined portion and the horizontal portion. Accordingly, the bottom surface of the discharge path does not include an inclined portion ascending toward the outlet opening. Therefore, the condensate water that has entered the discharge path is successfully discharged to the second space. As described above, the turbine can discharge the condensate water that is accumulated in the space where the bearing is provided in the housing. The discharge path serves both as a passage for discharging the gas and as a passage for discharging the condensate water. The discharge path having the above shape avoids being filled with the condensate water. When the turbine is stopped, even in a case where the condensate water is frozen due to a decrease in temperature, the gas flow path is secured in the discharge path.

In some examples, the housing includes a center housing in which the bearing is provided and which is connected to the turbine housing, and the center housing includes a communication port that is an outlet of the first space and faces the inlet opening of the discharge path. In this case, the condensate water that is present in the first space in the center housing is readily discharged from the communication port. Additionally, the example configuration facilitates the passage of discharged condensate water into the discharge path via the inlet opening.

In some examples, the turbine further includes a seal plate provided between the turbine housing and the center housing, and a guide path extending between the first space and the communication port is formed in an outer peripheral portion of the seal plate. The guide path formed in the seal plate can guide the condensate water, which is present in the first space, to the communication port. Therefore, the discharge of the condensate water through the communication port can be smoothly performed.

In some examples, both of a lower end of the communication port of the center housing and a lower end of the inlet opening of the discharge path of the turbine housing are positioned lower than the rotary shaft. In this case, the water level (level) of the condensate water is prohibited from reaching the rotary shaft. Therefore, for example, even in a case where the condensate water is frozen due to a decrease in temperature, the rotary shaft may be prevented from sticking to ice derived from the condensate water. As long as the rotary shaft can rotate in the housing, the turbine can be operated. The operation of the turbine causes an increase in temperature. As a result, the ice melts into water and the water can be discharged from the discharge path.

In some examples, a seal portion for the rotary shaft is provided between the bearing and the blade. In this case, for example, gas that has passed through the seal portion from a back surface of the blade, gas that has cooled the bearing, and so on can be collected in the first space to be discharged to the second space through the discharge path.

In the following description, with reference to the drawings, the same reference numbers are assigned to the same components or to similar components having the same function, and overlapping description is omitted. In this specification, the terms such as "upward and downward", "vertical", "horizontal", and "bottom surface" may be understood as being based on a state where a turbine is installed, unless otherwise indicated. Additionally, the terms "ascend" and "descend" may be understood as being based on a state where the turbine is installed and with reference to gravity.

An example centrifugal compressor will be described with reference to the electric supercharger 1 illustrated in FIG. 1. The electric turbocharger 1 may be applied to, for example, a fuel cell system. The electric turbocharger 1 may be a fuel cell air supply device. The fuel cell system may be, for example, a solid polymer electrolyte fuel cell (PEFC), a phosphoric acid fuel cell (PAFC), or other type of fuel cell system.

Figure 2:
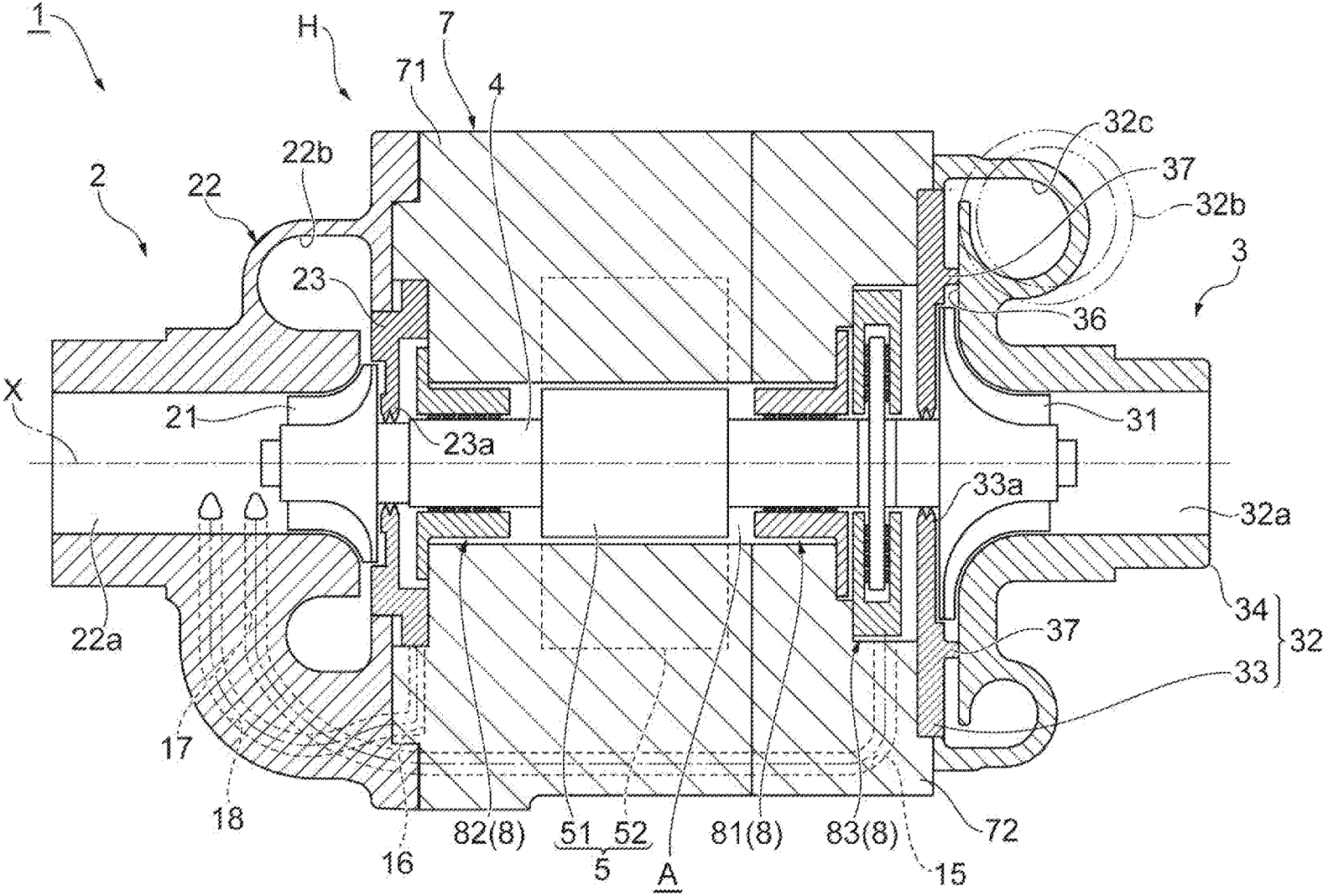
FIG. 2 is a cross-sectional view illustrating an example electric turbocharger (centrifugal compressor).

As illustrated in FIGS. 1 and 2, the example electric turbocharger 1 includes a turbine 2 and a compressor 3. The turbine 2 is, for example, an exhaust turbine for a fuel cell. The turbine 2 includes a rotary shaft 4 having a rotation axis X. A turbine impeller (blade) 21 is attached to one end of the rotary shaft 4, and a compressor impeller 31 is attached to the other end of the rotary shaft 4. A motor 5 that applies a rotational driving force to the rotary shaft 4 is installed between the turbine impeller 21 and the compressor impeller 31. Compressed air (one example of "compressed gas") G compressed by the compressor 3 is supplied to the fuel cell system as an oxidant (oxygen). A chemical reaction between a fuel and the oxidant occurs in the fuel cell system to generate electricity. Air containing water vapor is discharged from the fuel cell system, and the air is supplied to the turbine 2.

The electric turbocharger 1 rotates the turbine impeller 21 of the turbine 2 using high-temperature air discharged from the fuel cell system. The rotation of the turbine impeller 21 causes the compressor impeller 31 of the compressor 3 to rotate and the compressed air G to be supplied to the fuel cell system. In the electric turbocharger 1, a majority of the driving force of the compressor 3 may be applied by the motor 5. Namely, the electric turbocharger 1 may be a substantially motor-driven turbocharger.

The fuel cell system and the electric turbocharger 1 can be mounted in, for example, a vehicle (electric car). Electricity generated by the fuel cell system may be supplied to the motor 5 of the electric turbocharger 1; however, electricity may be supplied from an electric power source other than the fuel cell system.

The electric turbocharger 1 includes the turbine 2, the compressor 3, and an inverter 6 that controls the rotational drive of the motor 5. The turbine 2 includes a turbine housing 22, the turbine impeller 21 accommodated in the turbine housing 22, a motor housing (center housing) 7, the rotary shaft 4 and the motor 5 disposed in the motor housing 7, and an air bearing structure 8 which will be described later.

The compressor 3 includes a compressor housing 32 and the compressor impeller 31 accommodated in the compressor housing 32. The motor housing 7 is provided between the turbine housing 22 and the compressor housing 32. The rotary shaft 4 is rotatably supported by the air bearing structure (gas bearing structure) 8 in the motor housing 7. In some examples, a housing H of the electric turbocharger 1 includes the turbine housing 22, the compressor housing 32, and the motor housing 7. Among these housings, the turbine housing 22 and the motor housing 7 may constitute a housing of the turbine 2.

The turbine housing 22 is provided with an exhaust gas inlet port and an exhaust gas outlet port 22*a*. The air containing water vapor which is discharged from the fuel cell system flows into the turbine housing 22 through the exhaust gas inlet port. The inlet air passes through a turbine scroll 22*b* to be supplied to an inlet side of the turbine impeller 21. The turbine impeller 21 is, for example, a radial turbine that generates a rotation force using the pressure of the supplied air. Thereafter, the air flows outside the turbine housing 22 through the exhaust gas outlet port 22*a*.

The compressor housing 32 is provided with a suction port 32*a* and a discharge port 32*b*. When the turbine impeller 21 rotates as described above, the rotary shaft 4 and the compressor impeller 31 rotate. The rotating compressor impeller 31 suctions outside air through the suction port 32*a* to compress the air. The compressed air G compressed by the compressor impeller 31 passes through a compressor scroll 32*c* to be discharged from the discharge port 32*b*. The compressed air G discharged from the discharge port 32*b* is supplied to the fuel cell system.

The motor 5 is, for example, a brushless AC motor, and includes a rotor 51 that is a rotating component and a stator 52 that is a stationary component. The rotor 51 includes one or a plurality of magnets. The rotor 51 is fixed to the rotary shaft 4 and can rotate around the axis, together with the rotary shaft 4. The rotor 51 is disposed in a central portion of the rotary shaft 4 in an axial direction. The stator 52 includes a plurality of coils and cores. The stator 52 is disposed to surround the rotor 51 in a circumferential direction of the rotary shaft 4. The stator 52 generates a magnetic field around the rotary shaft 4 to thereby rotate the rotor 51 in cooperation with the rotor 51.

An example cooling structure that cools heat generated inside the turbocharger includes a heat exchanger (cooler) 9 attached to the motor housing 7, and a refrigerant line 10 and an air cooling line that pass through the heat exchanger 9. The refrigerant line 10 and the air cooling line are connected or fluidly coupled to each other to enable heat exchange inside the heat exchanger 9. A part of the compressed air G compressed by the compressor 3 passes through the air cooling line. In some examples, a part of the compressed air G is extracted to flow through the air cooling line as cooling air Ga. A coolant C, which has a lower temperature than the cooling air Ga passing through the air cooling line, passes through the refrigerant line 10.

The refrigerant line 10 is a part of a circulation line that is connected or fluidly coupled to a radiator provided outside the electric turbocharger 1. The temperature of the coolant C passing through the refrigerant line 10 is, for example, between approximately 50° C. and 100° C. The refrigerant line 10 includes a motor cooling portion 10*a* disposed along the stator 52, and an inverter cooling portion 10*b* disposed along the inverter 6. The coolant C that has passed through the heat exchanger 9 flows through the motor cooling portion 10*a* while circulating around the stator 52, to thereby cool the stator 52. Thereafter, the coolant C flows through the inverter cooling portion 10*b* along control circuits of the inverter 6, for example, in a meandering manner, to thereby cool the inverter 6. In some examples, the control circuit of the inverter 6 may comprise an insulated gate bipolar transistor (IGBT), a bipolar transistor, a MOSFET, a gate turn-off thyristor (GTO), or the like. The configuration of the flow path of the coolant C can be appropriately changed such that the coolant C can cool devices which are to be cooled.

The electric turbocharger 1 is configured such that the pressure on a compressor 3 side is higher than the pressure on a turbine 2 side. The air bearing structure 8 is cooled using the pressure difference. A part of the compressed air G compressed by the compressor 3 is extracted, the cooling air Ga is guided to the air bearing structure 8, and the cooling air Ga that has passed through the air bearing structure 8 is delivered to the turbine 2. The temperature of the compressed air G is, for example, approximately 170° C. even when the temperature is high, and is lowered to approximately 70 to 80° C. by the heat exchanger 9. Since the temperature of the air bearing structure 8 is 150° C. or higher without cooling, the air bearing structure 8 is suitably cooled by the supply of the cooling air Ga. In FIG. 2, the illustration of the heat exchanger 9 and the inverter 6 is omitted.

The motor housing 7 includes a stator housing 71 that accommodates the stator 52 surrounding the rotor 51, and a bearing housing 72 in which the air bearing structure 8 is provided. A shaft space (a part of a space in the housing H) A through which the rotary shaft 4 penetrates is formed in the stator housing 71 and the bearing housing 72. Labyrinth seal portions 33*a* and 23*a* that hold airtightness in the shaft space A are provided in both end portions of the shaft space A.

The compressor housing 32 accommodating the compressor impeller 31 is connected and fixed to the bearing housing 72 by a fastener such as a bolt or so on. The compressor housing 32 includes an impeller chamber 34 that accommodates the compressor impeller 31, and a diffuser plate 33 that has a disk shape and forms a diffuser 36 in cooperation with the impeller chamber 34. A plurality of vanes 37 disposed inside the diffuser 36 are fixed to the diffuser plate 33. The labyrinth seal portion 33*a* is provided in a central portion (around the rotary shaft 4) of the diffuser plate 33. An extraction hole that is an inlet of the air cooling line to extract a part of the compressed air G may be formed in the diffuser plate 33.

Figure 3:
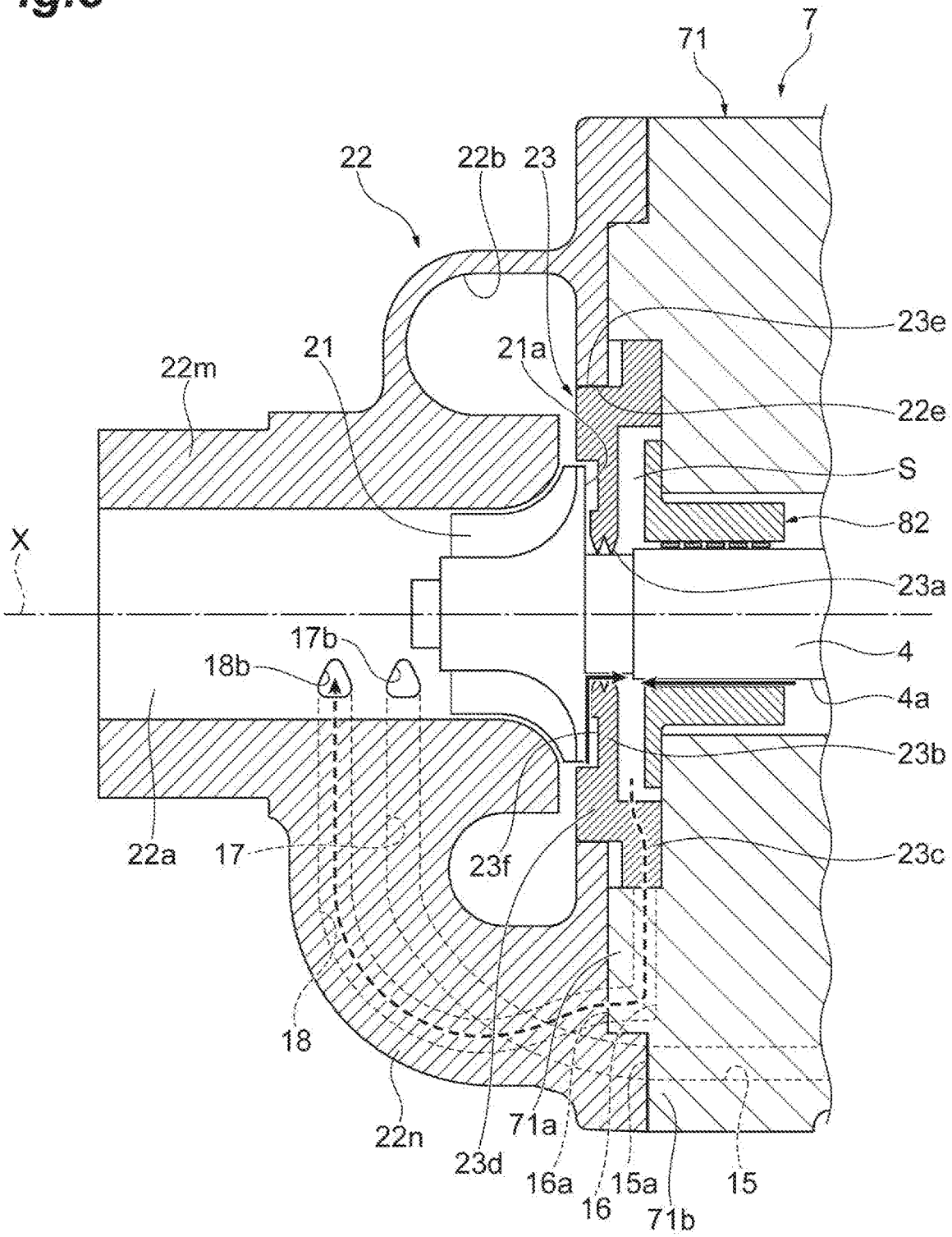
FIG. 3 is a cross-sectional view illustrating an enlargement of the vicinity of a turbine housing, a seal portion, and a bearing of FIG. 2.

The turbine housing 22 accommodating the turbine impeller 21 is connected and fixed to the stator housing 71 by a fastener such as a bolt or so on. As illustrated in FIGS. 2 and 3, a seal plate 23 having a disk shape is provided between the turbine housing 22 and the stator housing 71 (motor housing 7). The seal plate 23 forms a gas flow path between the turbine scroll 22*b* and the turbine impeller 21. The seal plate 23 may be a nozzle ring including a plurality of nozzle vanes disposed in the gas flow path. The labyrinth seal portion 23*a* is provided in a central portion (around the rotary shaft 4) of the seal plate 23. The labyrinth seal portion 23*a* that is a seal portion provided for the rotary shaft 4 holds the airtightness of a space (first space) S where a radial bearing 82 of the air bearing structure 8 is provided. The labyrinth seal portion 23*a* can prevent the air, which is discharged from the fuel cell system and contains water vapor, from flowing into the space S.

The example air bearing structure 8 that supports the rotary shaft 4 includes a pair of radial bearings 81 and 82 and a thrust bearing 83. The pair of radial bearings 81 and 82 restrict the movement of the rotary shaft 4 in a direction perpendicular to the rotary shaft 4 while allowing the rotary shaft 4 to rotate. The pair of radial bearings 81 and 82 are, for example, dynamic pressure air bearings (gas bearings) and are disposed to interpose the rotor 51 therebetween, the rotor 51 being provided in the central portion of the rotary shaft 4.

A first radial bearing 81 is provided in the bearing housing 72 and is disposed between the rotor 51 and the compressor impeller 31. A second radial bearing 82 is provided in the stator housing 71 and is disposed between the rotor 51 and the turbine impeller 21. The labyrinth seal portion 23*a* is provided between the second radial bearing 82 and the turbine impeller 21. The first radial bearing 81 and the second radial bearing 82 have substantially the same structure. As the rotary shaft 4 rotates, ambient air is drawn into a gap between the rotary shaft 4 and the first radial bearing 81 (wedge effect) to increase the pressure to thereby cause the first radial bearing 81 to obtain the load capacity. The first radial bearing 81 rotatably supports the rotary shaft 4 by virtue of the load capacity obtained by the wedge effect. The first radial bearing 81 may comprise, for example, a foil bearing, a tilting pad bearing, a spiral groove bearing or the like The thrust bearing 83 is provided in the bearing housing 72 and is disposed between the radial bearing 81 and the compressor impeller 31. The thrust bearing 83 restricts the movement of the rotary shaft 4 in the axial direction while allowing the rotary shaft 4 to rotate. The thrust bearing 83 is a dynamic pressure air bearing and is disposed between the first radial bearing 81 and the compressor impeller 31. The thrust bearing 83 has a structure where, as the rotary shaft 4 rotates, ambient air is drawn into a gap between the rotary shaft 4 and the thrust bearing 83 (wedge effect) to increase the pressure to thereby cause the thrust bearing 83 to obtain the load capacity. The thrust bearing 83 rotatably supports the rotary shaft 4 by virtue of the load capacity obtained by the wedge effect. The thrust bearing 83 may comprise, for example, a foil bearing, a tilting pad bearing, a spiral groove bearing or the like.

In some examples, gaps are formed between the rotary shaft 4 and the radial bearing 81, inside the thrust bearing 83, between the rotor 51 and the stator 52, and between the rotary shaft 4 and the radial bearing 82. The cooling air Ga passes through these gaps to thereby cool the bearings of the air bearing structure 8. A configuration different from the configuration where a part of the compressed air G is extracted to be introduced as the cooling air Ga may be adopted. For example, a part of the compressed air G discharged from the electric turbocharger 1 may be cooled outside and then return into the electric turbocharger 1 as cooling air. Cooling air other than the compressed air G may be introduced from another air source.

The cooling air Ga that has cooled the motor 5 and the radial bearing 82 is introduced to the exhaust gas outlet port (second space) 22*a* via a first flow path 16 formed in the motor housing 7 and a first discharge path 18 formed in the turbine housing 22. The first discharge path 18 is configured to discharge gas in the space S, in which the radial bearing 82 is provided, to the exhaust gas outlet port 22*a*. The cooling air Ga that has cooled the radial bearing 81 and the thrust bearing 83 is introduced to the exhaust gas outlet port 22*a* via a second flow path 15 formed in the motor housing 7 and a second discharge path 17 formed in the turbine housing 22. Both of the first discharge path 18 and the second discharge path 17 are, for example, flow paths having a circular cross-section.

Hereinafter, an example gas flow path provided in the turbine 2 will be described in more detail. Since the turbine 2 receives moist air discharged from the fuel cell system, for example, when the turbine 2 is stopped, condensate water may be accumulated in the motor housing 7. The gas flow path formed in the turbine housing 22 also serves as a discharge path for the condensate water. The turbine 2 has a structure where the condensate water is successfully discharged to a space downstream of the turbine impeller 21.

The motor housing 7 is provided with the first flow path 16 that connects or fluidly couples the space S of the shaft space A and the turbine housing 22. The motor housing 7 is also provided with the second flow path 15 that connects or fluidly couples the shaft space A and the turbine housing 22. The compressed air G that has reached the shaft space A via the heat exchanger 9 branches into a flow toward to the second flow path 15 and a flow toward the first flow path 16. The second radial bearing 82 is disposed on the flow path toward the first flow path 16. The cooling air Ga toward the first flow path 16 cools mainly the second radial bearing 82. The first radial bearing 81 and the thrust bearing 83 are disposed on the flow path toward the second flow path 15. The cooling air Ga toward the second flow path 15 cools mainly the first radial bearing 81 and the thrust bearing 83.

Additionally, as illustrated in FIG. 3, the first flow path 16 is connected or fluidly coupled to the second radial bearing 82. A bearing main body of the second radial bearing 82 is fixed to the stator housing 71. The turbine housing 22 is fixed to the stator housing 71. The seal plate 23 provided with the labyrinth seal portion 23*a* is disposed between the stator housing 71 and the turbine housing 22. The space S into which the cooling air Ga can flow is formed between the radial bearing 82 and the seal plate 23. An upstream inlet of the first flow path 16 is connected or fluidly coupled to the space S.

The first flow path 16 penetrates through the seal plate 23 and the stator housing 71. A first communication port 16*a* (refer to FIG. 7) that is an outlet of the first flow path 16 is connected or fluidly coupled to the first discharge path 18 formed in the turbine housing 22. Accordingly, the first discharge path 18 includes a first inlet opening 18*a* that communicates with the space S via the first flow path 16, and a first outlet opening 18*b* that opens to the exhaust gas outlet port 22*a* in the turbine housing 22 (refer to FIG. 8). The stator housing 71 includes the first communication port 16*a* (refer to FIG. 4) facing the first inlet opening 18*a* of the first discharge path 18. In some examples, the first communication port 16*a* is equivalent to an outlet of the space S. An orifice plate 42 that regulates the flow rate of the cooling air Ga may be provided between the first communication port 16*a* and the first inlet opening 18*a*.

As illustrated in FIG. 2, the second flow path 15 is connected or fluidly coupled to a space where the thrust bearing 83 is present. A gap into which the cooling air Ga can flow is present between an outer peripheral surface of a bearing main body of the thrust bearing 83 and the bearing housing 72. An upstream inlet of the second flow path 15 is connected or fluidly coupled to the gap. As illustrated in FIG. 3, the second flow path 15 penetrates the bearing housing 72 and the stator housing 71. An outlet of the second flow path 15 is connected or fluidly coupled to the second discharge path 17 formed in the turbine housing 22. Accordingly, the second discharge path 17 includes a second inlet opening 17*a* that faces the outlet of the second flow path 15 and a second outlet opening 17*b* that opens to the exhaust gas outlet port 22*a* in the turbine housing 22 (refer to FIG. 8). The stator housing 71 includes a second communication port 15*a* (refer to FIG. 4) facing the second inlet opening 17*a* of the second discharge path 17. An orifice plate 41 that regulates the flow rate of the cooling air Ga may be provided between the second communication port 15*a* and the second inlet opening 17*a*.

With reference to FIGS. 3 to 8, it can be seen that a structure related to a fluid (gas and liquid) may be present in the space S where the radial bearing 82 is provided. As illustrated in FIG. 3, moist air that has passed through a gap between a back surface 21*a* of the turbine impeller 21 and the seal plate 23 and has further passed through the labyrinth seal portion 23*a* may flow into the space S (refer to a solid-line arrow in the drawing). The cooling air Ga that has cooled the thrust bearing 83 may flow into the space S (refer to a solid-line arrow in the drawing). The air that has flown into the space S can be discharged to the exhaust gas outlet port 22*a* through the first flow path 16 and the first discharge path 18 (refer to the dotted-line arrow in the drawing).

Figure 5:
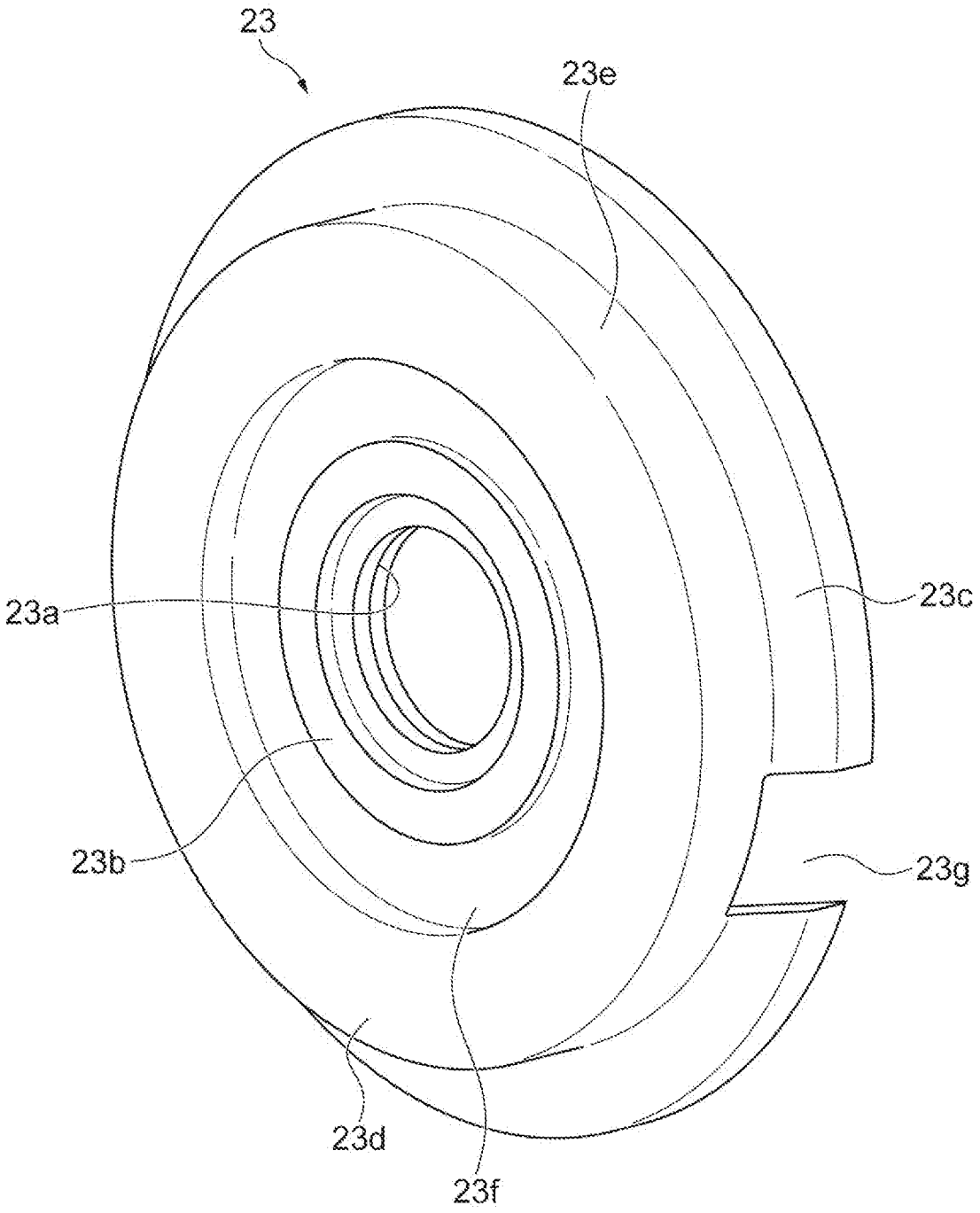
FIG. 5 is a perspective view illustrating the seal plate of FIG. 4.

As illustrated in FIGS. 3 and 5, the seal plate 23 includes a main body portion 23*b* that has an annular shape and includes the labyrinth seal portion 23*a* formed in an inner peripheral surface of the main body portion 23*b*, and a flange portion 23*c* that has an annular shape and is connected to an outer periphery of the main body portion 23*b*. A step is formed between the main body portion 23*b* and the flange portion 23*c*. A protrusion portion 23*d* having a cylindrical shape of the main body portion 23*b* is fitted into an opening that has a circular shape and is formed in the turbine housing 22. An outer peripheral surface 23*e* of the protrusion portion 23*d* is fitted to an inner peripheral surface 22*e* of the opening of the turbine housing 22. In some examples, the outer peripheral surface 23*e* may be equivalent to the step between the main body portion 23*b* and the flange portion 23*c*. The main body portion 23*b* may be provided with a groove portion 23*f* that has an annular shape and faces the back surface 21*a* of the turbine impeller 21 with a slight gap therebetween.

Figure 4:
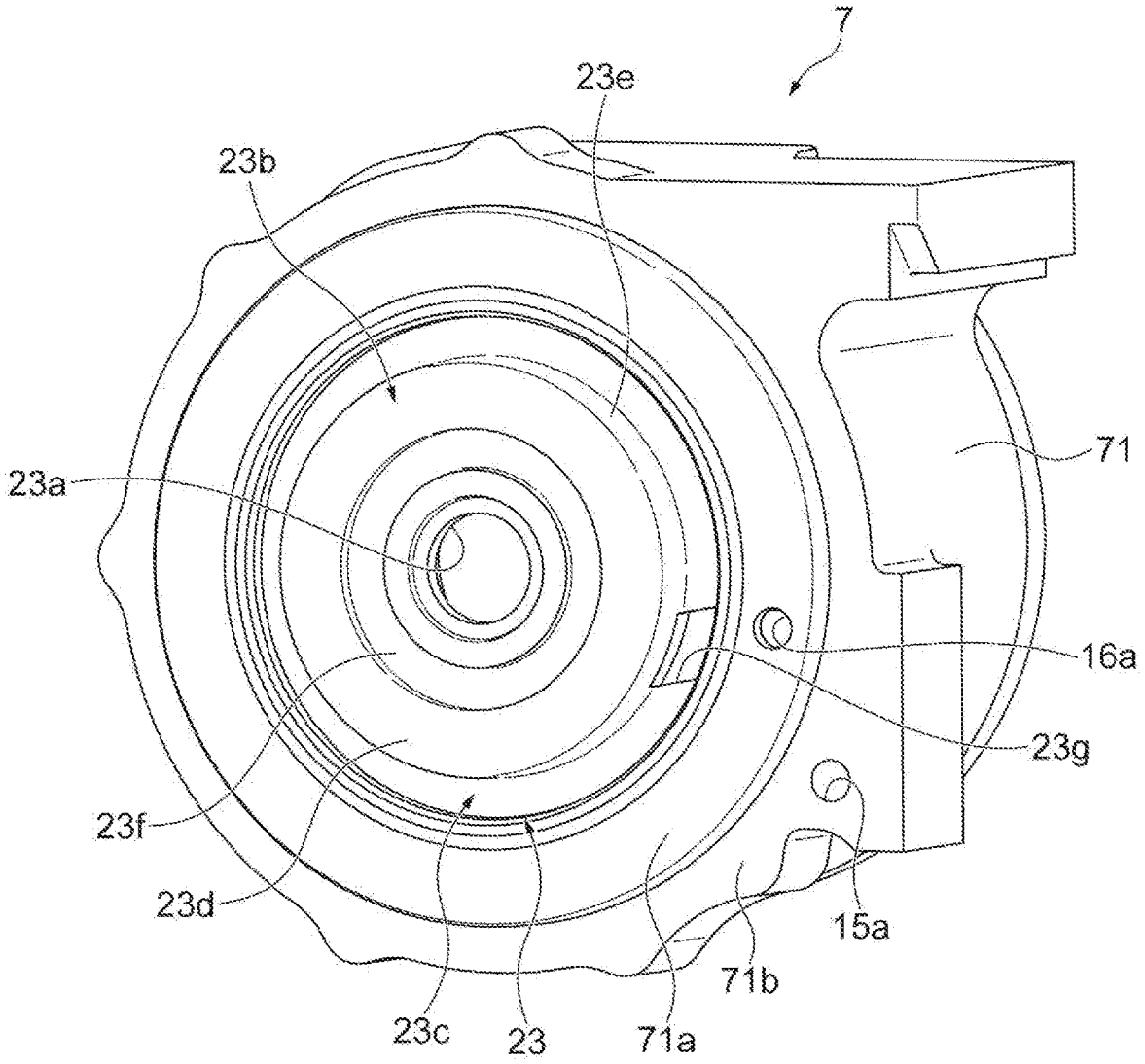
FIG. 4 is a perspective view illustrating an example assembly in which a seal plate is attached to a center housing.

As illustrated in FIGS. 3 and 4, the stator housing 71 includes a fitting portion 71*a* that has a cylindrical shape and protrudes toward the turbine housing 22, and an outer peripheral portion 71*b* that has an annular shape and is connected to an outer periphery of the fitting portion 71*a*. The fitting portion 71*a* is fitted into the turbine housing 22. Additionally, the flange portion 23*c* of the seal plate 23 is fitted into an inner peripheral side of the fitting portion 71*a*. The space S is formed on a back surface side of the seal plate 23, and a flow path constituting a part of the first flow path 16 is formed in the flange portion 23*c* of the seal plate 23.

Figure 6:
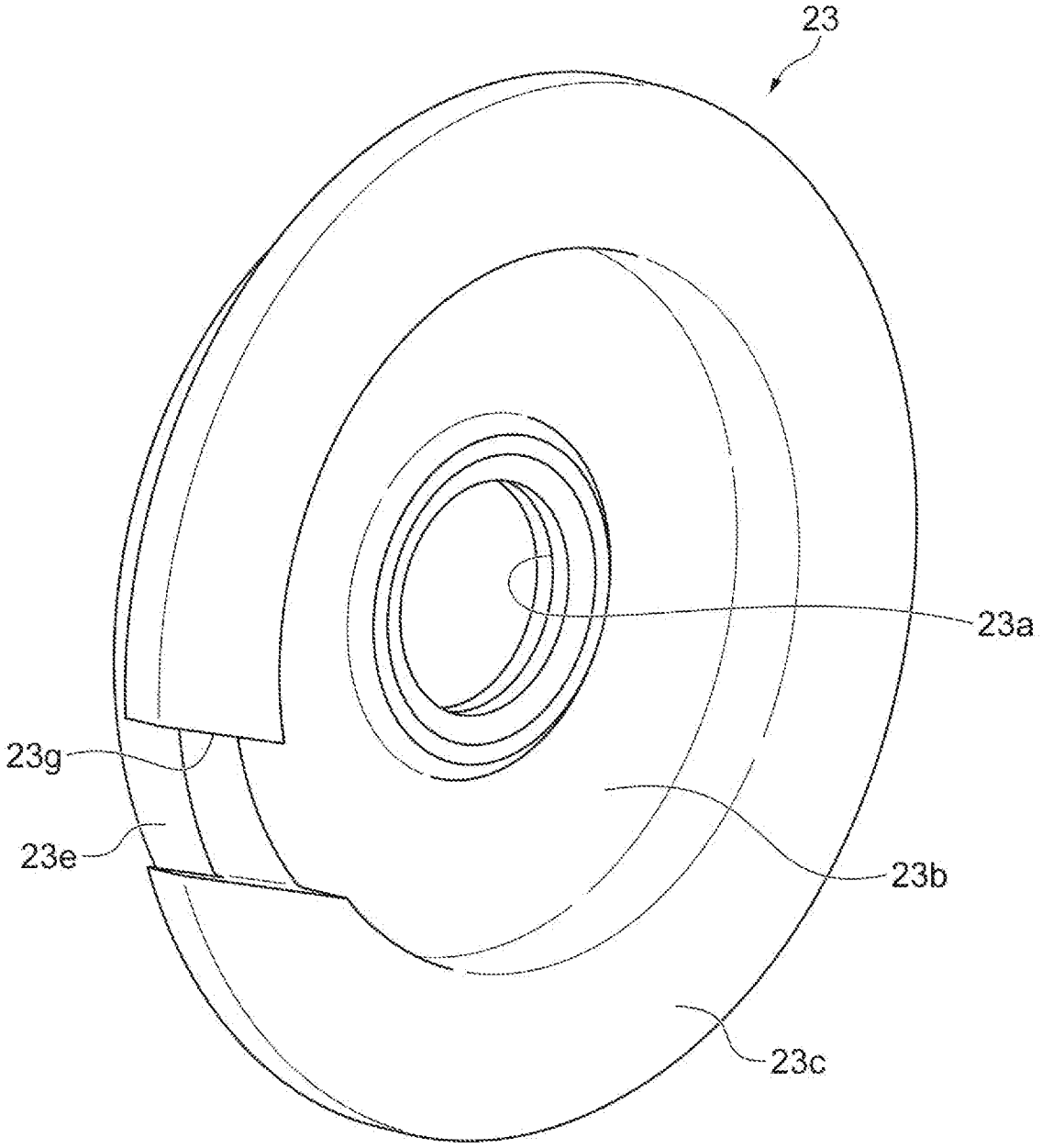
FIG. 6 is a perspective view illustrating the seal plate of FIG. 5 as seen from a back surface side.

In some examples, as illustrated in FIGS. 4 to 6, a guide path 23*g* that is a notch is formed in the flange portion 23*c* that is an outer peripheral portion of the seal plate 23. The guide path 23*g* penetrates through the flange portion 23*c* in a radial direction. The guide path 23*g* extends between the space S and the first communication port 16*a* of the first flow path 16. In some examples, the guide path 23.*g* is configured to guide the condensate water, which is accumulated in the space S, to the first flow path 16.

As illustrated in FIG. 4, the first communication port 16*a* of the first flow path 16 opens to an end surface of the fitting portion 71*a* of the stator housing 71 (also refer to FIG. 3). The second communication port 15*a* of the second flow path 15 opens to an end surface of the outer peripheral portion 71*b* of the stator housing 71 (also refer to FIG. 3).

Figure 7:
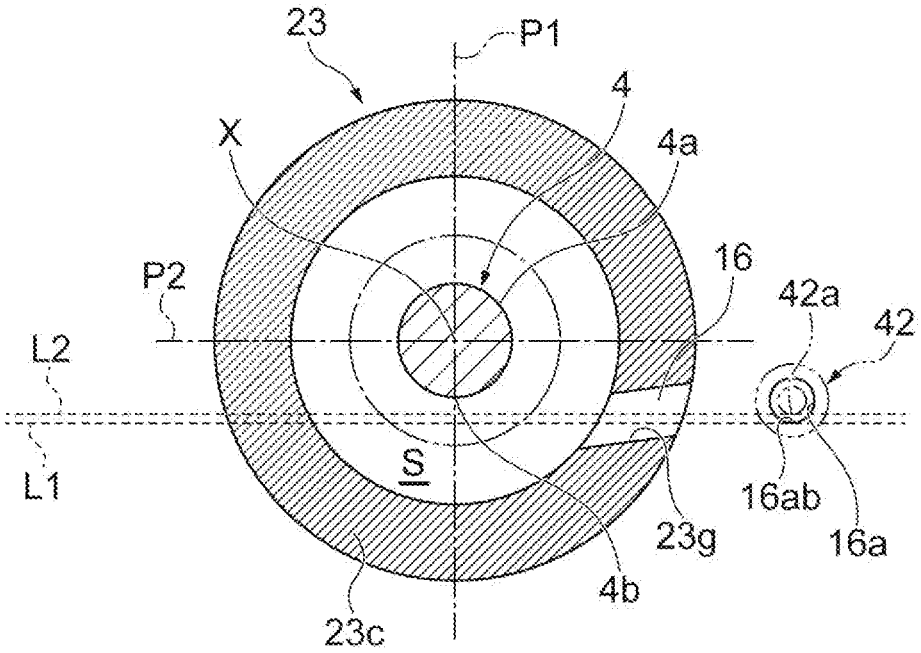
FIG. 7 is a cross-sectional view of the seal plate of FIG. 4 as seen from a turbine side in a rotation axis direction.
Figure 8:
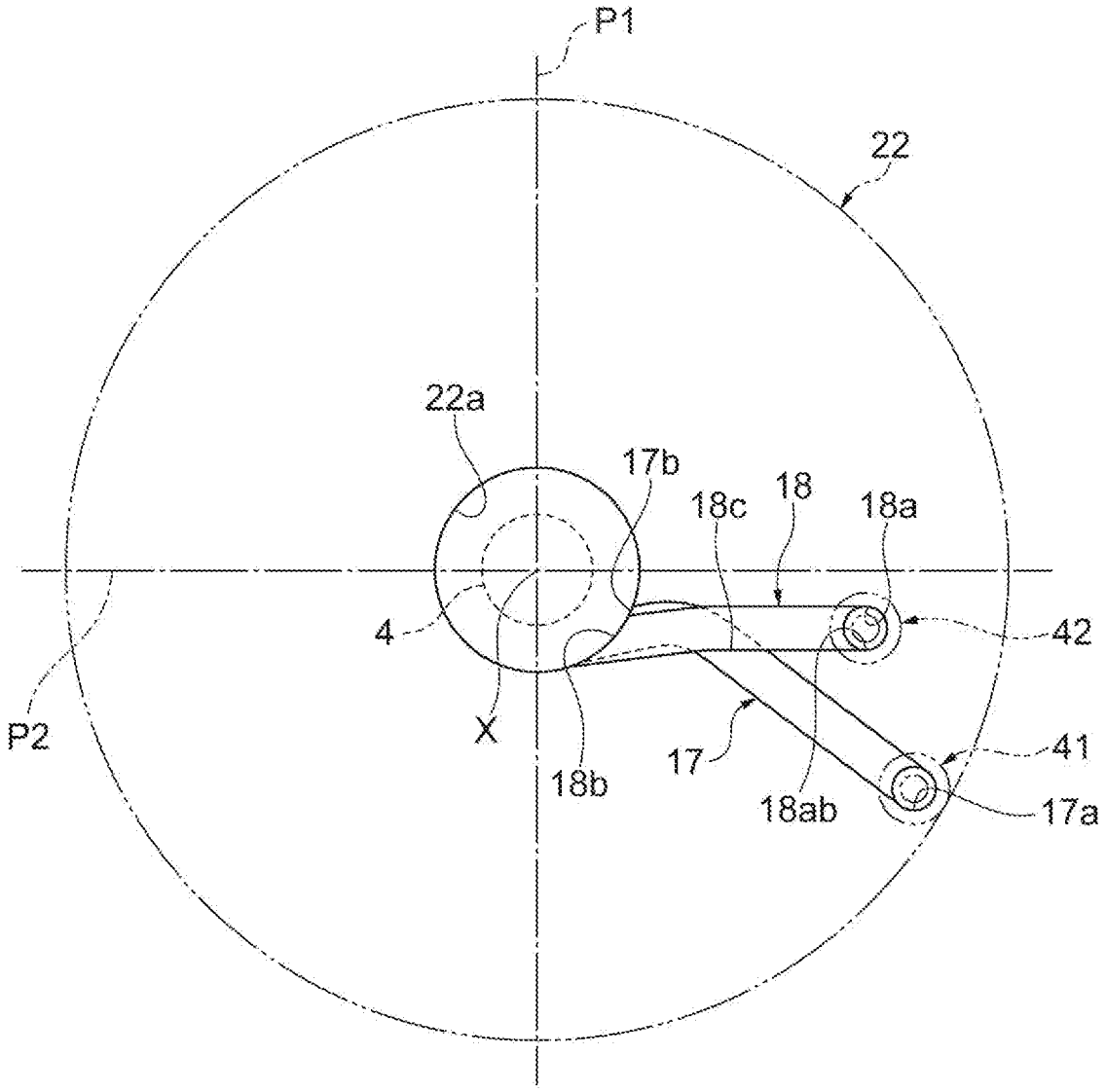
FIG. 8 illustrates the shape of an example discharge path formed in the turbine housing of FIG. 3 as seen from the turbine side in the rotation axis direction.

FIG. 7 is a cross-sectional view illustrating the structure of an area positioned deeper than the first communication port 16*a* as seen from the turbine 2 side in a rotation axis X direction. FIG. 8 is a view illustrating the shapes of the first discharge path 18 and the second discharge path 17 formed in the turbine housing 22 as seen from the turbine 2 side in the rotation axis X direction. As illustrated in FIGS. 7 and 8, both of the first communication port 16*a* of the first flow path 16 and the first inlet opening 18*a* of the first discharge path 18 have a circular shape and have substantially the same size. The first communication port 16*a* and the first inlet opening 18*a* facing each other are disposed such that the central axes thereof are aligned with each other. When the orifice plate 42 is disposed between the first communication port 16*a* and the first inlet opening 18*a*, the diameter of a hole portion of the orifice plate 42 is smaller than the diameter of each of the first communication port 16*a* and the first inlet opening 18*a*. Both of the second communication port 15*a* of the second flow path 15 and the second inlet opening 17*a* of the second discharge path 17 have a circular shape and have substantially the same size. The second communication port 15*a* and the second inlet opening 17*a* facing each other are disposed such that the central axes thereof are aligned with each other. When the orifice plate 41 is disposed between the second communication port 15*a* and the second inlet opening 17*a*, the diameter of a hole portion of the orifice plate 41 is smaller than the diameter of each of the second communication port 15*a* and the second inlet opening 17*a*.

In some examples, the first discharge path 18 has a predetermined slope. In FIGS. 7 and 8, a virtual vertical plane P1 and a virtual horizontal plane P2 based on a state where the electric turbocharger 1 (turbine 2) is assembled into an electric car and so on are illustrated. As illustrated in FIG. 8, a bottom surface 18*c* of the first discharge path 18 is constituted of a horizontal portion extending horizontally (namely, extending in parallel to the virtual horizontal plane P2) and an inclined portion descending from the first inlet opening 18*a* toward the first outlet opening 18*b*. The inclined portion continues downstream of the horizontal portion. Such a downslope in the first discharge path 18 facilitates the discharge of the condensate water to the exhaust gas outlet port 22*a*.

Additionally, as illustrated in FIG. 7, the first flow path 16 in the stator housing 71 ascends from the space S toward the first communication port 16*a*. For this reason, the guide path 23*g* of the seal plate 23, the guide path 23*g* forming a part of the first flow path 16, forms an angle with respect to the virtual horizontal plane P2. However, in the turbine 2, the height of the first communication port 16*a* is taken into consideration. Both of a lower end 16*ab* of the first flow path 16 and a lower end 42*a* of the orifice plate 42 are positioned lower than the rotary shaft 4. In some examples, both of the lower end 16*ab* of the first flow path 16 and the lower end 42*a* of the orifice plate 42 are positioned lower than a lower end 4*b* of the rotary shaft 4. Similarly, also a lower end 18*ab* (refer to FIG. 8) of the first inlet opening 18*a* is positioned lower than the rotary shaft 4.

For this reason, in a case where the orifice plate 42 is provided, the condensate water may be accumulated up to the vicinity of a second level L2 corresponding to the lower end 42*a* of the orifice plate 42. In a case where the orifice plate 42 is not provided, the condensate water may be accumulated up to the vicinity of a first level L1 corresponding to the lower end 16*ab* of the first communication port 16*a*. The condensate water at any level does not reach the lower end 4*b* of the rotary shaft 4.

As illustrated in FIG. 8, the second discharge path 17 is mainly constituted of an inclined portion ascending from the second inlet opening 17*a* toward the second outlet opening 17*b*. Since the air from the compressor 3, which passes through the second flow path 15 and the second discharge path 17, is relatively dry, the problem of condensate water does not occur. For this reason, the shape of the second discharge path 17 can be determined without the discharge of a liquid such as water being taken into consideration.

A positional relationship between the first discharge path 18 and the second discharge path 17 will be described. As illustrated in FIG. 3, both of the first discharge path 18 and the second discharge path 17 are formed on one side with respect to the virtual vertical plane P1. Both of the first discharge path 18 and the second discharge path 17 are formed on a lower side with respect to the virtual horizontal plane P2. The first outlet opening 18*b* of the first discharge path 18 is positioned farther from the turbine impeller 21 than the second outlet opening 17*b* of the second discharge path 17 in the rotation axis X direction. The example configuration may be understood to secure the downslope of the first discharge path 18.

In some examples, the gas in the space S where the radial bearing 82 is provided is discharged to the exhaust gas outlet port 22*a* in the turbine housing 22 through the first discharge path 18. If the gas flowing into the turbine 2 contains water vapor and condensate water generated by the condensation of the water vapor is accumulated in the motor housing 7, the condensate water may be accumulated also in the space S. When the water level of the condensate water reaches the first inlet opening 18*a* of the first discharge path 18, the condensate water enters the first discharge path 18. The bottom surface 18*c* of the first discharge path 18 is constituted of the inclined portion descending toward the first outlet opening 18*b* or is constituted of the inclined portion and the horizontal portion. Accordingly, the bottom surface 18*c* of the first discharge path 18 does not include an inclined portion ascending toward the first outlet opening 18*b*. Therefore, the condensate water that has entered the first discharge path 18 is successfully discharged to the exhaust gas outlet port 22*a*. As described above, the turbine 2 can discharge the condensate water that is accumulated in the space S where the radial bearing 82 is provided in the motor housing 7. The first discharge path 18 serves both as a passage for discharging the gas and as a passage for discharging the condensate water. The first discharge path 18 may therefore avoid being filled with the condensate water. For example, when the turbine 2 is stopped, even in a case where the condensate water is frozen due to a decrease in temperature, the gas flow path is secured in the first discharge path 18.

Since the motor housing 7 includes the first communication port 16*a* facing the first inlet opening 18*a* of the first discharge path 18, the condensate water that is present in the space S in the motor housing 7 is readily discharged from the first communication port 16*a*. Additionally, the example configuration facilitates the passage of discharged condensate water into the first discharge path 18 via the first inlet opening 18*a*.

Since the guide path 23*g* is formed in the flange portion 23*c* of the seal plate 23, the guide path 23*g* can guide the condensate water, which is present in the space S, to the first communication port 16*a*. Therefore, the discharge of the condensate water through the first communication port 16*a* can be smoothly performed.

Since both of the lower end 16*ab* of the first communication port 16*a* and the lower end 18*ab* of the first inlet opening 18*a* are positioned lower than the rotary shaft 4, the water level (level) of the condensate water is prohibited from reaching the rotary shaft 4. Therefore, for example, even in a case where the condensate water is frozen due to a decrease in temperature, the rotary shaft 4 may be prevented from sticking to ice derived from the condensate water. As long as the rotary shaft 4 can rotate in the motor housing 7, the turbine 2 can be operated. The operation of the turbine 2 causes an increase in temperature. As a result, the ice melts into water and the water can be discharged from the first discharge path 18.

The labyrinth seal portion 23*a* is provided between the radial bearing 82 and the turbine impeller 21. The gas that has passed through the labyrinth seal portion 23*a* from the back surface 21*a* of the turbine impeller 21, the cooling air Ga that has cooled the radial bearing 82, and so on can be collected in the space S to be discharged to the exhaust gas outlet port 22*a* through the first discharge path 18.

It is to be understood that not all aspects, advantages and features described herein may necessarily be achieved by, or included in, any one particular example. Indeed, having described and illustrated various examples herein, it should be apparent that other examples may be modified in arrangement and detail. For example, in other examples an axial turbine may include a discharge path having the same structure as that of the first discharge path 18. When the discharge path is applied to the axial turbine, the discharge path may connect a casing and a downstream side of a blade. When the discharge path is applied to a multi-stage axial turbine, the discharge path may be connected to an intermediate position between one stage and another stage.

The seal portion that holds airtightness in the shaft space A is not limited to the labyrinth seal portions 33*a* and 23*a*, and may be another type of seal portion.

The bottom surface 18*c* of the first discharge path 18 may be constituted of only an inclined portion descending from the first inlet opening 18*a* toward the first outlet opening 18*b*.

Additionally, the structure of the discharge path may be applied to a turbocharger that does not include a motor. The gas compressed by the centrifugal compressor may be gas other than air.

We claim all modifications and variations coming within the spirit and scope of the subject matter claimed herein.

I claim:

1. A turbine comprising:

a rotary shaft;

a blade attached to the rotary shaft;

a housing including a turbine housing that accommodates the blade; and a bearing provided in the housing to rotatably support the rotary shaft, wherein the housing includes a first space in which the bearing is provided and the turbine housing includes a second space fluidly coupled to the first space, the second space at least partially surrounding the blade in the turbine housing, the turbine housing includes a discharge path configured to discharge gas contained in the first space to the second space, the discharge path includes an inlet that is located adjacent to the first space and opens into the first space and an outlet that is located adjacent to the second space and opens into the second space, and a bottom surface of the discharge path includes an inclined portion that descends from the inlet at a non-perpendicular inclined angle with respect to the rotary shaft, the inlet positioned at a higher elevation than the outlet.

2. The turbine according to claim 1, wherein the housing includes a center housing in which the bearing is provided and which is connected to the turbine housing, and the center housing includes a communication port of the first space that faces the inlet of the discharge path.

3. The turbine according to claim 2, further comprising:

a seal plate provided between the turbine housing and the center housing, wherein a guide path extending between the first space and the communication port is formed in an outer peripheral portion of the seal plate.

4. The turbine according to claim 2, wherein both of a lower end of the communication port of the center housing and a lower end of the inlet of the discharge path of the turbine housing are positioned lower than the rotary shaft.

5. The turbine according to claim 2, further comprising:

a seal plate provided between the turbine housing and the center housing, the seal plate including a flange portion formed in an outer peripheral portion of the seal plate, wherein the seal plate includes a guide path penetrating through the flange portion in a radial direction of the seal plate and extending between the first space and the communication port.

6. The turbine according to claim 1, wherein the outlet that is located adjacent to the second space is positioned at a lower elevation than the rotary shaft.

7. A turbine comprising:

a rotary shaft;

a blade attached to the rotary shaft;

a turbine housing that accommodates the blade; and a center housing which is connected to the turbine housing, wherein the center housing includes a first space and the turbine housing includes a second space fluidly coupled to the first space, the second space at least partially surrounding the blade in the turbine housing, the turbine housing includes a discharge path configured to discharge gas in the first space to the second space, the discharge path includes an inlet that opens into the first space and an outlet that opens into the second space, the outlet positioned at a lower elevation than the rotary shaft, and the discharge path descends from the inlet toward the outlet so as to discharge condensate water from the first space to the second space.

8. The turbine according to claim 7, wherein the center housing includes a communication port of the first space that faces the inlet of the discharge path.

9. The turbine according to claim 8, further comprising:

a seal plate provided between the turbine housing and the center housing, wherein a guide path extending between the first space and the communication port is formed in an outer peripheral portion of the seal plate.

10. The turbine according to claim 8, wherein both of a lower end of the communication port of the center housing and a lower end of the inlet of the discharge path of the turbine housing are positioned lower than the rotary shaft.

11. The turbine according to claim 8, further comprising:

a seal plate provided between the turbine housing and the center housing, the seal plate including a flange portion formed in an outer peripheral portion of the seal plate, wherein the seal plate includes a guide path penetrating through the flange portion in a radial direction of the seal plate to extend between the first space and the communication port.

12. The turbine according to claim 7, wherein a seal portion for the rotary shaft is provided between the turbine housing and the center housing.

13. A turbine comprising:

a rotary shaft;

a blade attached to the rotary shaft;

a center housing in which the rotary shaft is disposed; and a turbine housing which is connected to the center housing, wherein the center housing includes an inside space and the turbine housing includes an exhaust gas outlet port disposed downstream of the blade, the turbine housing includes a discharge path that fluidly couples the inside space to the exhaust gas outlet port, the discharge path includes an inlet that is located adjacent to the inside space and opens into the inside space and an outlet that is located adjacent to the exhaust gas outlet port and opens into the exhaust gas outlet port, and at least part of the discharge path descends from the inlet toward the outlet, the inlet positioned at a higher elevation than the outlet.

14. The turbine according to claim 13, wherein the center housing includes a communication port of the inside space that faces the inlet of the discharge path.

15. The turbine according to claim 14, further comprising:

a seal plate provided between the turbine housing and the center housing, wherein a guide path extending between the inside space and the communication port is formed in an outer peripheral portion of the seal plate.

16. The turbine according to claim 14, wherein both of a lower end of the communication port of the center housing and a lower end of the inlet of the discharge path of the turbine housing are positioned lower than the rotary shaft.

17. The turbine according to claim 14, further comprising:

a seal plate provided between the turbine housing and the center housing, the seal plate including a flange portion formed in an outer peripheral portion of the seal plate, wherein the seal plate includes a guide path penetrating through the flange portion in a radial direction of the seal plate to extend between the inside space and the communication port.

18. The turbine according to claim 13, wherein the outlet that is located adjacent to the exhaust gas outlet port is positioned at a lower elevation than the rotary shaft.

19. The turbine according to claim 13, wherein the discharge path comprises:

a horizontal portion that descends from the inlet; and an inclined portion that extends from the horizontal portion to the outlet.

20. The turbine according to claim 13, wherein the discharge path descends from the inlet and extends to the outlet to form a linear discharge path extending between the inlet and the outlet at a non-perpendicular inclined angle with respect to the rotary shaft.

* * * * *